US010400960B1

(12) United States Patent
Vincent et al.

(10) Patent No.: US 10,400,960 B1
(45) Date of Patent: Sep. 3, 2019

(54) LED RETROFIT ASSEMBLY WITH ELECTRICALLY BIASED SUPPORT STRUCTURE

(71) Applicant: Principal Lighting Group, LLC, San Angelo, TX (US)

(72) Inventors: John Bryan Vincent, San Angelo, TX (US); Nicholas Keith Kadlacek, San Angelo, TX (US)

(73) Assignee: Principal Lighting Group, LLC, San Angelo, TX (US)

( * ) Notice: Subject to any disclaimer, the term of this patent is extended or adjusted under 35 U.S.C. 154(b) by 0 days.

(21) Appl. No.: 16/183,555

(22) Filed: Nov. 7, 2018

(51) Int. Cl.

| | |
|---|---|
| ***F21K 9/272*** | (2016.01) |
| ***F21K 9/90*** | (2016.01) |
| ***F21K 9/275*** | (2016.01) |
| ***F21V 23/06*** | (2006.01) |
| *F21Y 115/10* | (2016.01) |

(52) U.S. Cl.
CPC ..... *F21K 9/272* (2016.08); *F21K 9/275* (2016.08); *F21K 9/90* (2013.01); *F21V 23/06* (2013.01); *F21Y 2115/10* (2016.08)

(58) Field of Classification Search
CPC . F21K 9/272; F21K 9/275; F21K 9/90; F21K 9/27; F21K 9/20; F21V 23/06; F21V 17/00; F21V 19/00; F21V 21/00; F21V 21/005; F21V 23/00; F21Y 2115/10
See application file for complete search history.

(56) References Cited

U.S. PATENT DOCUMENTS

| | | | | |
|---|---|---|---|---|
| 7,871,180 | B2 * | 1/2011 | Wu | F21S 2/00 362/217.13 |
| 9,004,716 | B2 * | 4/2015 | Ai | F21S 2/00 362/217.17 |
| 9,964,289 | B2 * | 5/2018 | Pearson | F21V 21/005 |
| 10,222,052 | B1 * | 3/2019 | Ter-Hovhannisyan | F21V 31/005 |

* cited by examiner

*Primary Examiner* — Bao Q Truong
(74) *Attorney, Agent, or Firm* — Jackson Walker L.L.P.

(57) ABSTRACT

A lighting assembly includes an LED string affixed to a lamp support connected between first and second lighting sockets and includes an non-conductive coupling and a pair of conductive support segments. Each support segment is connected between the coupling a corresponding lighting socket, either directly or via an intervening endcap. The LED string includes an LED module and a pair of interconnects. The LED module includes one or more LEDs and power circuitry for coupling a supply voltage to the LEDs. The interconnect pair may include positive and negative interconnects. A fixed end of each interconnect is electrically and mechanically connected to a corresponding support segment. The first support segment is electrically coupled to a positive terminal of a voltage source and the second support segment is electrically coupled to a negative terminal of the voltage source, the interconnect pair conveys a supply voltage to each LED module.

20 Claims, 3 Drawing Sheets

LED RETROFIT ASSEMBLY WITH ELECTRICALLY BIASED SUPPORT STRUCTURE

BACKGROUND

Fluorescent lamps have been widely used for a variety of commercial, industrial, consumer, and other lighting applications including, as an important but non-limiting example, commercial signage since the 1930's. More recently, lamps employing one or more light emitting diodes (LEDs) as the primary source of illumination have created a market for retrofitting signs containing fluorescent tubes with LED-based products or devices. Some of the benefits of LED lighting include, without limitation, reduced energy consumption, longer service life, safer and less hazardous materials, and a less complex and less expensive power supply. The enormous installed base of illuminated signs employing fluorescent tubes makes it desirable to implement LED retrofit products that can be installed directly into the existing fluorescent tube sockets. However, the power source for a fluorescent tube generally includes a ballast to control and limit the flow of current to the fluorescent tube. In contrast, LED lamps are generally powered by a DC power supply that provides a constant or substantially constant supply voltage and/or supply current. As a result, it is not generally feasible to install an LED lamp product in the fluorescent tube socket without disconnecting, modifying, or replacing the power circuit coupled to the socket.

SUMMARY

For purposes of this disclosure, the term "conductive" is equivalent to "electrically conductive" unless indicated otherwise and refers to a resistivity less than approximately $10^{-7}$ Ω-m. In addition, the term "non-conductive" is equivalent to "electrically non-conductive" unless indicated otherwise and refers to a resistivity greater than approximately $10^{10}$ Ω-m.

In accordance with subject matter included herein, a disclosed lighting assembly includes a support structure, also referred to herein as a lamp support, to which one or more LED strings are affixed, whether releasably or otherwise. The lamp support may be configured to connect between a first lighting socket and a second lighting socket. The lamp support may include an electrically non-conductive coupling and first and second conductive support segments. In at least one embodiment, a first end of the first conductive support segment is coupled to a first end of the electrically non-conductive coupling while a first end of the second conductive support segment is coupled to a second end of the electrically non-conductive coupling.

Each LED string may include one or more LED modules and a pair of interconnects collectively referred to herein as an interconnect pair. Each LED module may include one or more LEDs and power circuitry for receiving a supply voltage and providing an operating voltage to the one or more LEDs. The interconnect pair may include a conductive positive interconnect a conductive negative interconnect. Each interconnect may include a fixed end and a free end wherein the fixed end is electrically and mechanically connected to one of the support segments while the free end of each interconnect may be "floating", i.e., not electrically connected to another structure. In at least some embodiments, the fixed end of the negative interconnect is affixed to the second conductive support segment while the fixed end of the positive interconnect is affixed to the first conductive support segment. If the first conductive support segment is electrically coupled to a positive terminal of a voltage and the second conductive support segment is electrically coupled to a negative terminal of the voltage source, the interconnect pair is configured to convey a supply voltage provided by the voltage source to the power circuitry of each LED module.

The electrically non-conductive coupling may include a centrally positioned spacer located between a first cavity, extending from a first end of the coupling to a first surface of the spacer, and a second cavity, extending from a second end of the coupling to a second surface of the spacer. The first cavity may be configured to receive a second end of the first support segment while the second cavity may be configured to receive a second end of the second support segment. The first support segment may comprise an elongated member having a rectangular or square cross section surrounding a corridor that extends the length of the support segment. Each cavity may comprise an annular void defined by a perimeter portion of the coupling surrounding an interior portion, wherein the annular void is configured to receive an end of a support segment.

Each support segment may have a polygonal cross section that defines a plurality of planar surfaces. One or more LED strings may be affixed to any one or more of the planar surfaces.

Each socket may include a conductive element including a forward contact point and a rearward contact point of the socket. The forward contact point may be exposed or otherwise accessible when the socket is empty, enabling a support segment, or an endcap attached to an end of a support segment, to contact the forward contact point when inserted into the socket. The rearward contact point may be exposed or otherwise accessible at a rearward side of the socket, for connecting to a cable or wire connected to a terminal of a power supply. The rearward contact point of the first socket may be connected to a positive terminal of the power supply and the rearward contact point of the second socket may be connected to a negative terminal of the power supply. In such embodiments, the first contact is biased relative to the second socket when the power supply is activated. The power supply may provide a low voltage and constant current or constant voltage supply signal. The magnitude of the low voltage supply signal may be 12 V, 24 V or another suitable value.

When the first support segment is connected to the first socket and the second support segment is connected to the second socket, the first support segment is biased relative to the second support segment. If the fixed end of the positive interconnect is affixed to the first support segment and the fixed end of the second interconnect is affixed to the second socket, the interconnect pair carries a supply voltage produced by the power supply. The interconnect pair may be routed to each LED module on the LED string and thereby power all of the corresponding LEDs. In this manner, the support segments provide a portion of the interconnection between the power supply and the LEDs, making it unnecessary to employ wires or other discrete interconnects that extend beyond physical dimensions of the support structure.

In direct connection embodiments, the support segments connect directly to the forward contact points in the corresponding sockets. In endcap embodiments, an endcap is attached at each end of the support structure and each endcap includes its own conductive element, also referred to herein as a conductive tab, to electrically couple the support segment to the forward contact point of the socket.

BRIEF DESCRIPTION OF THE DRAWINGS

A more complete understanding of disclosed subject matter and advantages thereof may be acquired by referring to the following description taken in conjunction with the accompanying drawings, in which like reference numbers indicate like features, and wherein.

DETAILED DESCRIPTION

Figure 1:
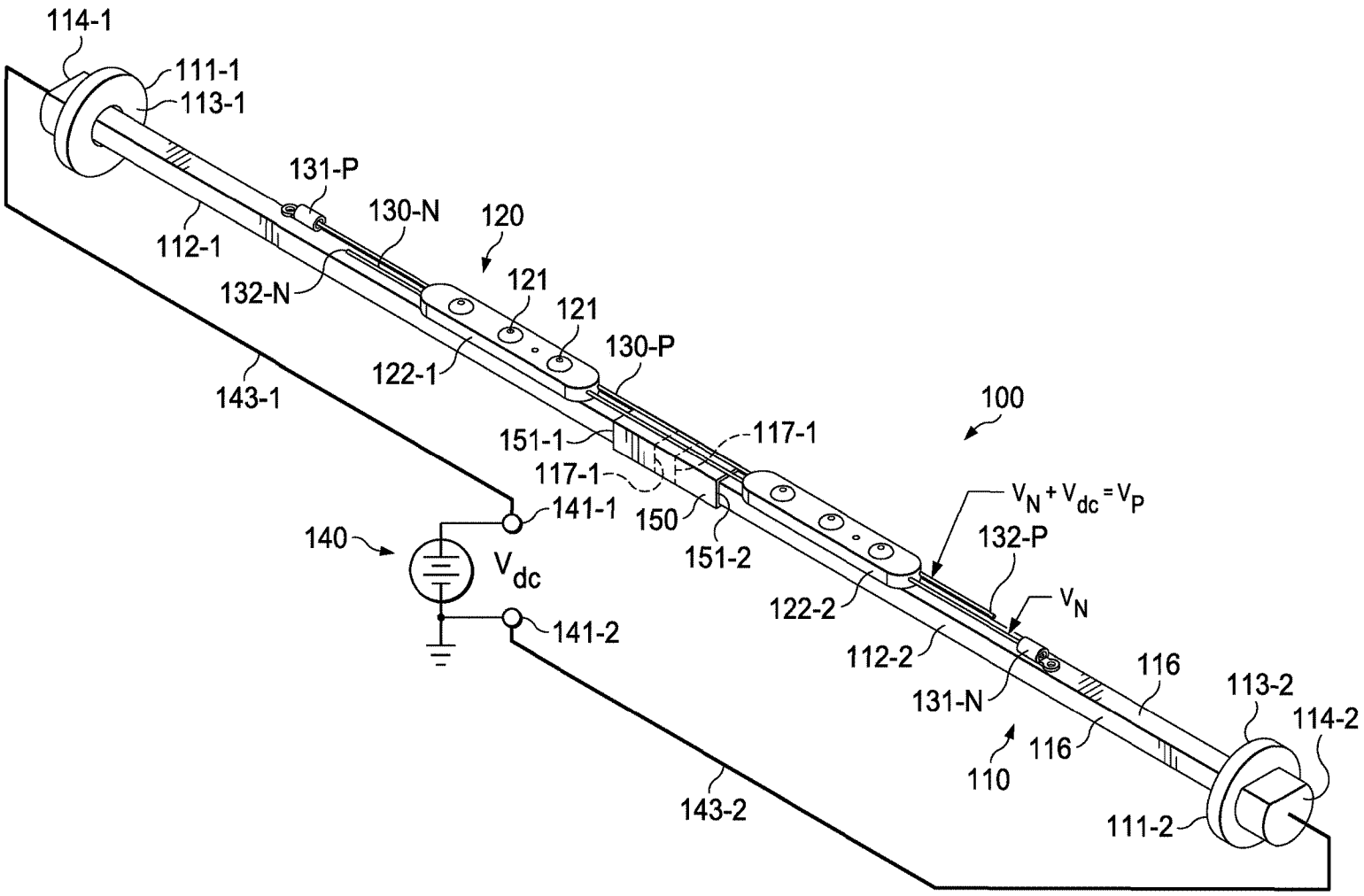
FIG. 1 is a perspective view of an LED retrofit assembly.
Figure 2:
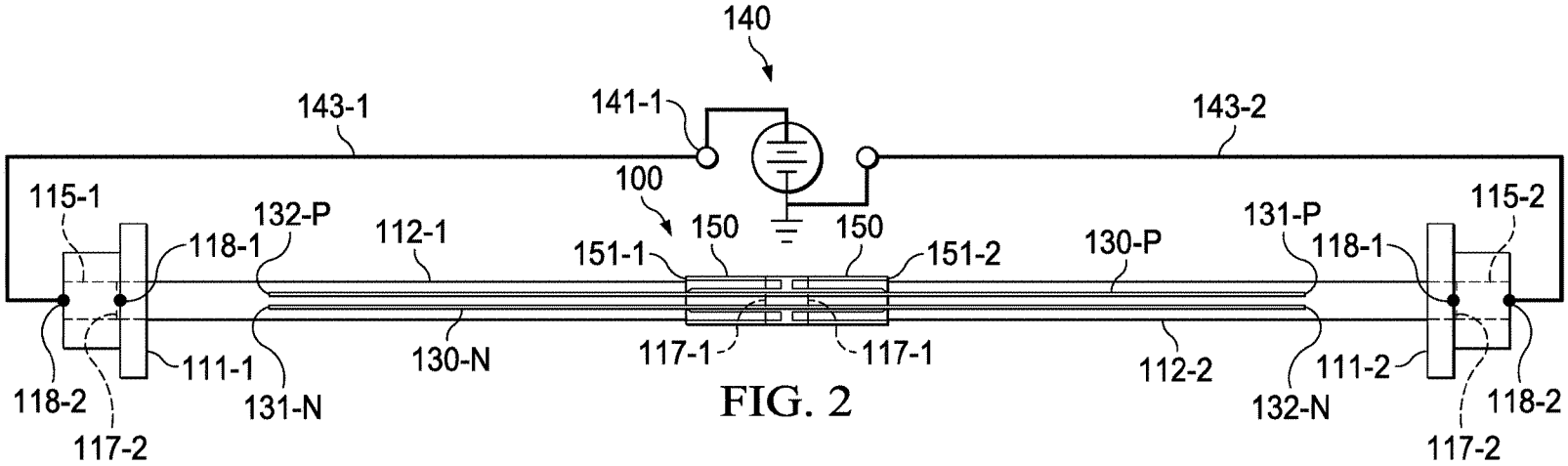
FIG. 2 is a top view of an LED retrofit assembly.

FIG. 1 and FIG. 2 illustrate an LED retrofit assembly 100 although it is to be noted that the LED modules 122 illustrated in FIG. 1 are omitted from FIG. 2 for the sake of clarity. The LED retrofit assembly 100 illustrated in FIG. 1 includes an LED support 110 to which an LED string 120 is attached. The LED support 110 illustrated in FIG. 1 has a square or rectangular cross section defining four planar LED support surfaces 116. In other embodiments, LED support 110 may have a triangular cross section defining three planar surfaces, a pentagonal cross section defining five planar surfaces, a hexagonal cross section defining six planar surfaces, or any other polygonal cross section defining a corresponding number of planar LED support surfaces 116. In some embodiments, the cross section of LED support 110 may be a circular, elliptical, or some other shape defining one or more curved surfaces. In still other embodiments, the cross section of LED support 110 may include one or more planar surfaces and one or more curved surfaces.

The LED retrofit assembly 100 illustrated in FIG. 1 includes one LED string 120. In some embodiments, LED retrofit assembly 100 includes two or more LED strings 120. The LED retrofit assembly 100 illustrated in FIG. 1 includes an LED string 120 mounted on one of the four planar LED support surfaces 116 of LED support 110. In some embodiments, LED strings 120 may be mounted on two or more of the planar LED support surfaces 116 of LED support 110. The LED string 120 illustrated in FIG. 1 includes two LED modules 122, each of which includes three LEDs 121. In other embodiments, each LED string 120 may include more or fewer LED modules 122 than the illustrated LED string 120 and each LED module 122 may include more or fewer LEDs 121 than the illustrated LED modules 122.

Figure 3:
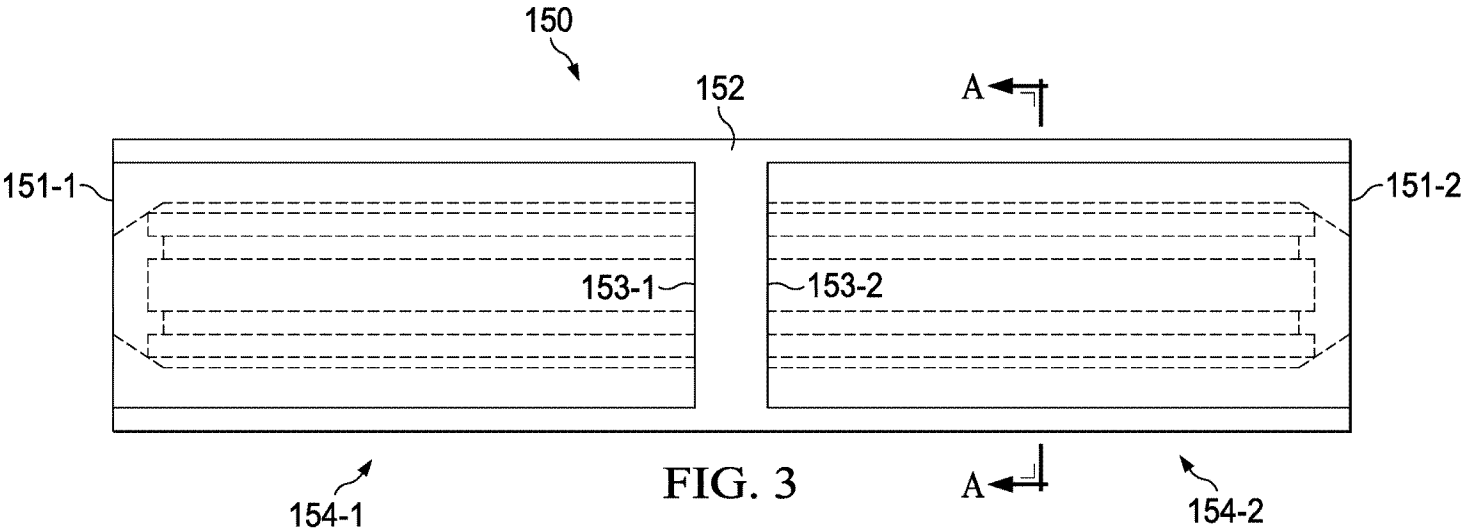
FIG. 3 is a top view of an electrically non-conductive coupling.

The LED support 110 illustrated in FIG. 1 includes two support segments 112 and a coupling 150. Referring to FIG. 3, coupling 150 is illustrated with a mid-plane spacer 152 positioned between a first cavity 154-1 and a second cavity 154-2. The first cavity 154-1 of FIG. 3 extends from a first end 151-1 of coupling 150 to a first surface 153-1 of mid-plane spacer 152 while the second cavity 154-2 extends from a second end 151-2 of coupling 150 to a second surface 153-2 of mid-plane spacer 152. Referring again to FIG. 1, LED support 110 is illustrated with a first end 117-1 of first electrically conductive support segment, referred to herein simply as first support segment 112-1, received in first cavity 154-1 of coupling 150 while a first end 117-1 of second support segment 112-2, referred to herein simply as second support segment 112-2 is received in second cavity 154-2.

In at least one embodiment, each support segment 112 is a conductive structure or a structure that includes a conductive exterior surface while coupling 150 is an electrical insulator or includes an electrically insulating portion that electrically insulates first support segment 112-1 from second support segment 112-2. While the specific compositions of support segments 112 and coupling 150 may vary, embodiments of support segment 112 include metallic embodiments comprised of aluminum, copper, steel, or another suitable metal as well as alloys thereof. Other embodiments of support segments 112 include highly-doped semiconductor embodiments. Embodiments of coupling 150 include, without limitation, plastic embodiments, including thermoplastic embodiments and thermosetting polymer embodiments, "glass" embodiments including silicon-oxide compound embodiments, ceramic embodiments, and other embodiments of any suitable electrically non-conductive material or compound.

In the LED support 110 illustrated in FIG. 1 and FIG. 2, coupling 150 and support segments 112 are separate and distinct components that are attached or otherwise affixed to each other to form LED support 110. In at least one embodiment, support segments 112 are metallic and coupling 150 is comprised of vulcanized rubber or another suitable electrically non-conductive thermoset. In other embodiments, LED support 110 may be a monolithic structure fabricated to form a highly non-conductive region, corresponding to coupling 150, between highly conductive regions corresponding to support segments 112. In one such monolithic embodiment of LED support 110, end portions of a substrate of silicon or another semi-conductive material are selectively and highly doped with impurities to form support segments 112 having the requisite electrical conductivity while a central portion of the substrate is oxidized or otherwise processed to form an electrically insulative structure to function as the coupling 150.

The LED retrofit assembly 100 illustrated in FIG. 1 is depicted connected to a socket 111 at each end of LED support 110. Each of the sockets 111 illustrated in FIG. 1 includes an inward face 113 and an outward face 114. The inward face 113 may be physically configured to receive and/or support a second end 117-2 of support segment 112. Each outward face 114 of socket 111 may be physically configured to connect to a cable, wire, or another structure suitable for functioning as a supply interconnect 143 and each supply interconnect 143 may be coupled to a corresponding power supply terminal 141 of a power supply 140. In at least one embodiment, power supply 140 functions as a voltage source configured to provide a constant or substantially constant supply voltage, Vdc.

In embodiments suitable for use in LED retrofit applications, sockets 111 include any socket with a physical configuration suitable for receiving and/or supporting any of various fluorescent tube formats well known in the industry including, as non-limiting examples, recessed double contact sockets for T8 or T12 bi-pin or high output (HO) tubes. Each socket 111 may include a conductive element 115 providing a conductive path between a first contact point 118-1 positioned at a first end of the conductive element 115 and a second contact point 118-2 positioned at a second end of each conductive element 115 configured to electrically couple support segment 112 to a corresponding supply interconnect 143. Thus, first socket 111-1 may include a first conductive element 115-1 for coupling first support segment 112-1 to first supply interconnect 143-1, which is in turn connected to a first terminal 141-1 of power supply 140.

The first terminal 141-1 illustrated in FIG. 1 is the positive terminal although this is not necessarily true in other implementations. Similarly, second socket 111-2 may include a second conductive element 115-2 coupling the second support segment 112-2 to second supply interconnect 143-2, which is in turn connected to a second terminal 141-2 of power supply 140. The second terminal 141-2 illustrated in FIG. 1 is the negative terminal or ground terminal although this is not necessarily true in other implementations. In this manner, power supply 140 is configured to bias first support segment 112-1 relative to second support segment 112-2.

The LED string 120 illustrated in FIG. 1 includes a module interconnect pair 130 that includes two conductive interconnects, including a first module interconnect referred to herein as positive module interconnect 130-P and a second module interconnect, referred to herein as negative module interconnect 130-N. The positive module interconnect 130-P illustrated in FIG. 1 extends from a positive fixed point 131-P, through each of the LED modules 122, to a positive floating point 132-P. Similarly, the negative module interconnect 130-N illustrated in FIG. 1 extends from a negative fixed point 131-N, through each of the LED modules 122, to a negative floating point 132-N. Thus, the positive module interconnect 130-P illustrated in FIG. 1 provides a conductive path between positive fixed point 131-P and positive floating point 132-P while the negative module interconnect 130-N illustrated in FIG. 1 provides a conductive path between negative fixed point 131-N and negative floating point 132-N.

As illustrated in FIG. 1, positive module interconnect 130-P is physically and electrically affixed, attached, connected or otherwise coupled to first support segment 112-1 and negative module interconnect 130-N is physically and electrically affixed, attached, connected, or otherwise coupled to second support segment 112-2. In embodiments of LED retrofit assembly 100 with support segments 112 that are conductive, first support segment 112-1, in conjunction with first conductive element 115-1, illustrated in FIG. 2, of first socket 111-1, electrically couples positive fixed point 131-P to a first terminal 141-1 of power supply 140. Similarly, second support segment 112-2, in conjunction with second conductive element 115-2, illustrated in FIG. 2, of second socket 111-2, electrically couples negative module interconnect 130-N to a second terminal 141-2 of power supply 140. In such embodiments, Vp, the voltage of positive module interconnect 130-P, exceeds Vn, the voltage of negative module interconnect 130-N by the DC supply voltage, Vdc, i.e., Vp=Vn+Vdc. Thus, positive module interconnect 130-P and negative module interconnect 130-N convey the supply voltage, Vdc, to each of the LED modules 122 in LED string 120.

Figure 5:
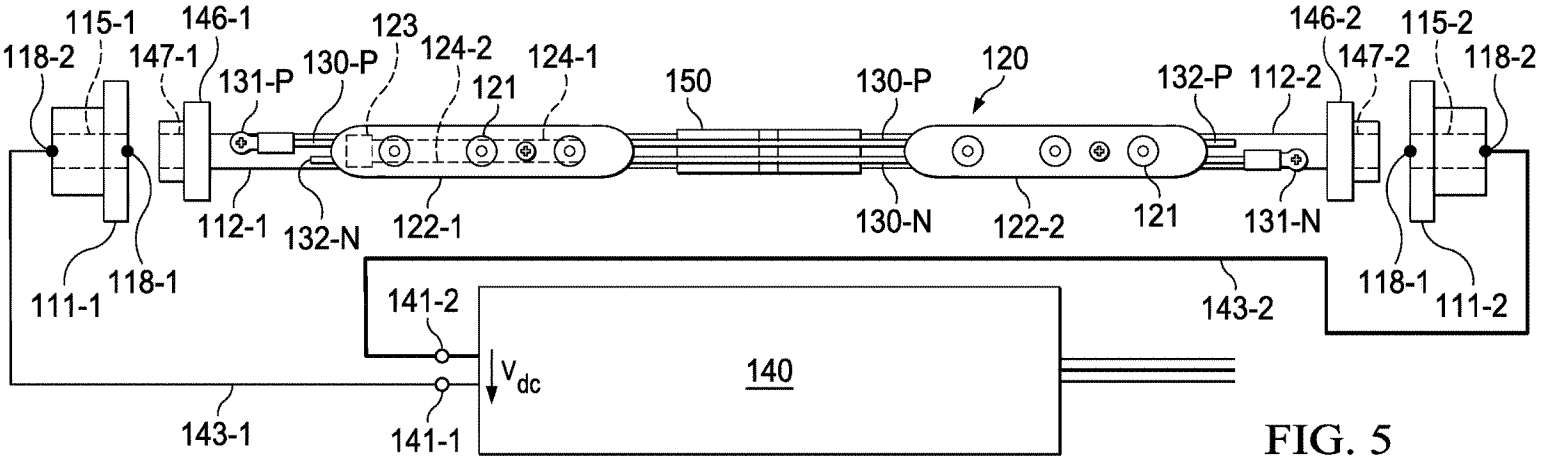
FIG. 5 is a second perspective view of an LED retrofit assembly.

Turning momentarily to FIG. 5, the LED modules 122 may include LED circuitry 123 configured to receive the supply voltage Vdc and further configured to provide, via LED internal interconnects 124-1 and 124-2, an operating voltage Vop to each LED 121. LED circuitry 123 may include voltage conversion and stabilization circuitry for use with embodiments wherein Vdc and Vop differ.

Returning to FIG. 1 and FIG. 2, Portions of positive module interconnect 130-P and negative module interconnect 130-N extending between LED modules 122 may comprise conductive wires or cables while portions of positive module interconnect 130-P and negative module interconnect 130-N within each LED module 122 may comprise traces of copper, aluminum, gold, silver, highly doped silicon or another conductive material, compound, or alloy. The LED strings 120 may include circuitry (not depicted in FIG. 1) suitable for receiving the supply voltage Vdc and further configured to provide an operating voltage Vo, to each of the LEDs 121 such that the LEDs 121 produce visible light when the interconnect pair 130 is coupled to power supply 140 and power supply 140 is activated. This circuitry, examples of which will be well known to one of ordinary skill in the field of LED circuits, may include passive elements, such as resistors capacitors, and inductors, and active elements including one or more transistors.

Each LED 121 may include one or more light-producing elements, compounds, or materials that exhibit a characteristic color when electrically activated. In some embodiments, one or more LEDs 121 may include a single light-emitting material that produces a characteristic color. In other embodiments, some or all of the LEDs 121 include two or more light-emitting materials, each of which produces a corresponding characteristic color. In these embodiments, a characteristic color of LED 121 may reflect a combination of the emitted-light from each of the light-emitting materials. In a 2-color embodiment, each LED 121 includes two light emitting components, the first of which emits a first color and the second of which emits a second color and the combination of the two colors results in a third color that differs from the first color and the second color. As a non-limiting example, each LED 121 may include a first light-emitting elements, which emits a blue or bluish light, and a second lighting-emitting element, which emits a yellow or yellowish light, wherein the combination of the two lights results in a white or whitish light.

The positive fixed point 131-P illustrated in FIG. 1 is electrically and mechanically coupled to first support segment 112-1 while positive floating point 132-P is floating freely, i.e., not electrically coupled to another structure. The negative fixed point 131-N illustrated in FIG. 1 is electrically and mechanically coupled to second support segment 112-2 while negative floating point 132-N is floating. In this configuration, first support segment 112-1 functions as an extension of positive module interconnect 130-P while second support segment 112-2 functions as an extension of second support segment 112-2.

In at least one embodiment, a first conductive element 115-1 within first socket 111-1 electrically couples first terminal 141-1 of power supply 140, via first supply interconnect 143-1, to first support segment 112-1. Similarly, a second conductive element 115-2 within second socket 111-2 electrically couples second terminal 141-2 of power supply 140, via second supply interconnect 143-2 to second support segment 112-2. In these embodiments, there is a voltage differential, equal to or substantially equal to the supply voltage Vdc, between first support segment 112-1 and second support segment 112-2.

Figure 4:
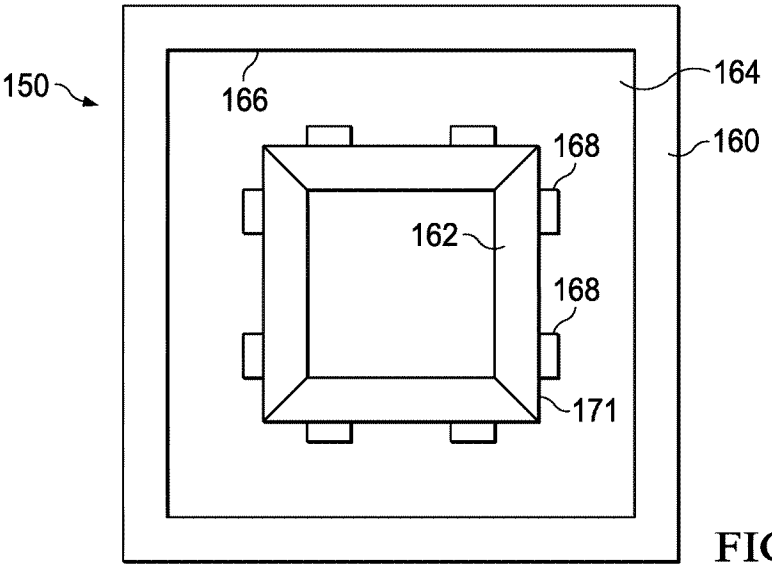
FIG. 4 is a section view taken along line A-A of the electrically non-conductive coupling of FIG. 3.

Referring to FIG. 3 and FIG. 4, a top view and section view of coupling 150 are illustrated. In at least some embodiments, coupling 150 is comprised of or includes an electrically non-conductive material such as a rubber, plastic, glass, or ceramic material. The illustrated coupling 150 includes a mid-plane spacer 152 positioned between first cavity 154-1 and second cavity 154-2. Each cavity 154 is suitable for and configured to receive an end of a support segment 112 (not depicted in FIG. 4). Each cavity 154 illustrated in FIG. 3 extends from an end 151 of coupling 150 to a corresponding surface 153 of mid-plane spacer 152. The mid-plane spacer 152 illustrated in FIG. 3 and FIG. 4 is a solid, continuous section of electrically non-conductive material that provides electrical isolation between a first support segment 112-1 (not depicted in FIG. 4) received in first cavity 154-1, and a second support segment 112-2 (not depicted in FIG. 4), which is received in second cavity 154-2.

The coupling 150 illustrated in FIG. 4 includes a coupling perimeter 160 and a coupling interior 162 that define an annular void that surrounds coupling interior 162 that serves as the cavity 164. The illustrated coupling 150 and cavity 164 are suitable for use with a support segment 112 having a square or rectangular cross section, wherein an inner surface 166 of coupling perimeter 160 is configured to engage an exterior surface of a support segment 112 and wherein tabs 168 formed on an outer surface 171 of coupling interior 162 are configured to engage an interior surface of the support segment. Although FIG. 3 and FIG. 4 illustrate a cavity 164 configured for use with hollowed square or rectangular support segments, suitable configurations are not limited to hollowed square or rectangular support segments. Thus, as a non-limiting example, support segments with hollowed triangular cross sections may be used with a coupling 150 and cavity 164 that are triangular, and so forth.

FIG. 5 illustrates an LED retrofit assembly 100 that includes endcaps 146 at each end of LED support 110. As discussed above, the LED retrofit assembly 100 illustrated in FIG. 1 includes an LED support 110 designed for direct connection to a pair of socket 111, i.e., without any end cap or other structure positioned between the second end 117-2 of each support segment 112 and the corresponding socket 111. For such embodiments, LED support 110 is sized to fit within the recess or opening defined by socket 111. FIG. 5 illustrates an LED retrofit assembly 100 that includes endcaps 146 attached to each end of support segment 112. In at least some such embodiments, each endcap 146 is configured to fit within the socket 111. In these embodiments, each endcap 146 includes a conductive tab 147 configured to electrically connect or otherwise couple a support segment 112 to a conductive element 115 in socket 111 to provide electrical continuity from each power supply terminal 141 to a corresponding support segment 112 via supply interconnect 143, conductive element 115 of socket 111, and conductive tab 147 in endcap 146.

Coupling positive module interconnect 130-P to first terminal 141-1 of power supply 140 and negative module interconnect 130-N to second terminal 141-2 of power supply 140 via interconnect paths that include a support segment 112 of LED support 110 and a conductive element 115 in socket 111, beneficially eliminates the need for wires or other retrofit assembly interconnects that extend beyond the physical boundaries of the support segments 112.

Disclosed subject matter encompasses all changes, substitutions, variations, alterations, and modifications to the examples illustrated in the drawings and described herein that a person having ordinary skill in the art would comprehend. Similarly, where appropriate, the appended claims encompass all changes, substitutions, variations, alterations, and modifications to the examples illustrated and described herein that a person having ordinary skill in the art would comprehend.

What is claimed is:

1. A lighting assembly, wherein the lighting assembly comprises:

a lamp support configured to connect between a first socket and a second socket, wherein the lamp support includes:

an electrically non-conductive coupling;

a first electrically conductive support segment, wherein a first end of the first electrically conductive support segments is coupled to a first end of the electrically non-conductive coupling; and a second electrically conductive support segment, wherein a first end of the second electrically conductive support segments is coupled to a second end of the electrically non-conductive coupling; and a light emitting diodes (LED) string affixed to the lamp support, wherein the LED string comprises:

an LED module, wherein the LED module includes:

one or more LEDs; and

LED circuitry for:

receiving a supply voltage from a power supply; and providing an operating voltage to the one or more LEDs;

a module interconnect pair configured to convey the supply voltage to the LED circuitry, wherein the module interconnect pair includes:

a first module interconnect, wherein a first end of the first module interconnect is electrically and physically affixed to the first electrically conductive support segment; and a second module interconnect, wherein a first end of the second module interconnect is electrically and physically affixed to the second electrically conductive support segment.

2. The lighting assembly of claim 1, wherein the electrically non-conductive coupling includes a spacer positioned between a first cavity and a second cavity, wherein:

the first cavity extends from the first end of the electrically non-conductive coupling to a first surface of the spacer; and the second cavity extends from the second end of the electrically non-conductive coupling to a second surface of the spacer;

the first cavity is configured to receive the first end of the first electrically conductive support segment; and the second cavity is configured to receive the first end of the second electrically conductive support segment.

3. The lighting assembly of claim 2, wherein the first electrically conductive support segment has a rectangular cross section defining a rectangular corridor and wherein the first cavity includes a perimeter and an interior portion defining an annular void configured to receive the first end of the first electrically conductive support segment.

4. The lighting assembly of claim 1, wherein the LED string includes a plurality of LED modules.

5. The lighting assembly of claim 1, wherein each electrically conductive support segment includes a plurality of planar surfaces including a first planar surface and a second planar surface and wherein the LED string comprises a first LED string affixed to the first planar surface and wherein the lighting assembly further includes a second LED string affixed to the second planar surface.

6. The lighting assembly of claim 1, wherein:

the first socket includes a first element, wherein the first element provides an electrically conductive path between a first forward contact point and a first rearward contact point, wherein the first forward contact point is located at a first end of the first element, within a recess of the first socket, and wherein the first rearward contact point is located at a second end of the first element; and the second socket includes a second element, wherein the second element provides an electrically conductive path between a second forward contact point and a second rearward contact point, wherein the second forward contact point is located at a first end of the second element, within a recess of the second socket, and wherein the second rearward contact point is located at a second end of the second element.

7. The lighting assembly of claim 6, wherein the first rearward contact point is coupled to a first supply interconnect coupled to a positive terminal of the power supply and wherein the second rearward contact point is coupled to a second supply interconnect coupled to a negative terminal of the power supply.

8. The lighting assembly of claim 7, wherein a second end of the first electrically conductive support segment is configured to connect directly to the first forward contact point and wherein a second end of the second electrically conductive support segment is configured to connect directly to the second forward contact point.

9. The lighting assembly of claim 7, further comprising a first endcap affixed to the second end of the first electrically conductive support segment and a second endcap affixed to the second end of the second electrically conductive support segment, wherein the first endcap is further configured to connect to the first socket and the second endcap is configured to connect to the second socket.

10. The lighting assembly of claim 9, wherein the first endcap includes a first electrically conductive tab providing an electrically conductive path between the first electrically conductive support segment and the first forward contact point and wherein the second endcap includes a second electrically conductive tab providing an electrically conductive path between the second electrically conductive support segment and the second forward contact point.

11. A method, wherein the method comprises:

forming a support structure suitable for connecting between a first socket and a second socket of a lighting assembly, wherein forming the support structure includes:

coupling a first end of a first electrically conductive support segment to a first end of an electrically non-conductive coupling; and coupling a first end of a second electrically conductive support segment to a second end of the electrically non-conductive coupling;

affixing a light emitting diode (LED) string to the support structure, wherein the LED string includes:

an LED module, wherein the LED module includes:

one or more LEDs; and

LED circuitry configured to:

receive a supply voltage from a voltage source; and provide an operating voltage to the one or more LEDs;

a module interconnect configured to convey the supply voltage to the LED circuitry, wherein the module interconnect includes:

a first module interconnect, wherein a first end of the first module interconnect is electrically and physically affixed to the first electrically conductive support segment; and a second module interconnect, wherein a first end of the second module interconnect is electrically and physically affixed to the second electrically conductive support segment.

12. The method of claim 11, wherein:

the first socket includes a first element extending between a first forward contact point and a first rearward contact point, wherein the first rearward contact point is connected to a first supply interconnect connected to a positive terminal of the voltage source; and the second socket includes a second element extending between a second forward contact point and a second rearward contact point, wherein the second rearward contact point is connected to a second supply interconnect connected to a ground terminal of the voltage source.

13. The method of claim 12, wherein:

a second end of the first electrically conductive support segment is configured to connect directly to the first forward contact point; and a second end of the second electrically conductive support segment is configured to connect directly to the second forward contact point.

14. The method of claim 12, wherein the support structure includes:

a first endcap attached to a second end of the first electrically conductive support segment and configured to be received in the first socket, wherein the first endcap includes a first electrically conductive tab configured to connect the second end of the first electrically conductive support segment to the first forward contact point; and a second endcap attached to a second end of the second electrically conductive support segment and configured to be received in the second socket, wherein the second endcap includes a second electrically conductive tab configured to connect the second end of the second electrically conductive support segment to the second forward contact point.

15. The method of claim 12, wherein the first socket and the second socket comprise recessed, double contact sockets.

16. The method of claim 11, wherein the electrically non-conductive coupling includes a spacer positioned between:

a first cavity, extending from the first end of the electrically non-conductive coupling to a first surface of the spacer, wherein the first cavity is configured to receive the first end of the first electrically conductive support segment and a second cavity, extending from the second end of the electrically non-conductive coupling to a second surface of the spacer, wherein the second cavity is configured to receive the first end of the second electrically conductive support segment.

17. The method of claim 16, wherein:

a cross section of the first electrically conductive support segment includes a rectangular ring defining a rectangular corridor;

a cross section of the first cavity includes a perimeter and an interior portion defining an annular void; and the annular void of the first cavity is configured to receive the rectangular ring of the first electrically conductive support segment.

18. The method of claim 11, wherein the LED string includes a plurality of LED modules.

19. The method of claim 11, wherein the support structure has a polygonal cross section comprising a plurality of sides and wherein each of the plurality of sides corresponds to one of a plurality of planar surfaces.

20. The method of claim 19, wherein the method includes:

affixing one or more LED strings to each of two or more of the plurality of planar surfaces.

* * * * *